US005392793A

United States Patent [19]

Molloy

[11] Patent Number: 5,392,793

[45] Date of Patent: Feb. 28, 1995

[54] SMOKING ARTICLE WITH MEANS TO RAISE TEMPERATURE OF SMOKE

[75] Inventor: Peter J. Molloy, London, England

[73] Assignee: Rothmans International Services Limited, London, Great Britain

[21] Appl. No.: 152,681

[22] Filed: Nov. 16, 1993

Related U.S. Application Data

[63] Continuation-in-part of Ser. No. 782,953, Oct. 25, 1981, abandoned.

[30] Foreign Application Priority Data

Oct. 26, 1990 [GB] United Kingdom ..... 9023386

[51] Int. Cl.[6] ..... A24D 1/00

[52] U.S. Cl. ..... 131/339; 131/333; 131/334

[58] Field of Search ..... 131/333, 334, 339, 360, 131/331, 364

[56] References Cited

U.S. PATENT DOCUMENTS

| | | | |
|---|---|---|---|
| 2,349,551 | 5/1944 | Helm | 131/360 |
| 3,318,316 | 5/1967 | Banderas et al. | 131/339 X |
| 3,349,776 | 10/1967 | Bell et al. | 131/364 |
| 3,457,927 | 7/1969 | Siragusa | 131/339 |
| 3,759,270 | 9/1973 | Wright | 131/339 |
| 3,905,377 | 9/1975 | Yatrides | 131/364 |
| 4,016,887 | 4/1977 | Uroshevich | 131/339 X |
| 4,027,679 | 6/1977 | Kaswan . | |
| 4,142,534 | 3/1979 | Brantl | 131/331 |
| 5,050,621 | 9/1991 | Creighton et al. | 131/333 |

FOREIGN PATENT DOCUMENTS

| | | | |
|---|---|---|---|
| 2808759 | 9/1978 | Germany | 131/333 |

*Primary Examiner*—Vincent Millin
*Assistant Examiner*—William M. Pierce
*Attorney, Agent, or Firm*—Diller, Ramik & Wight

[57] ABSTRACT

A smoking article comprising tubular support means to carry a supply of smoking material therein and to provide first and second ends thereof, said first end being located for ignition and said second end being directed towards filter means attached to said tubular support, said filter means including a transversely extending barrier located in a collection zone and on which particulate matter in the smoke from the smoking material is deposited when said second end is ignited and smoke is drawn through the smoking material to the filter means, and heating means for raising the temperature of said collection zone above that which would exist in the absence of said temperature raising means to raise the temperature of said smoke from said smoking material entering said zone and particulate material deposited on said transversely extending barrier, to release semi-volatile compounds therefrom.

32 Claims, 3 Drawing Sheets

SMOKING ARTICLE WITH MEANS TO RAISE TEMPERATURE OF SMOKE

CROSS-REFERENCE TO RELATED APPLICATION

This application is a continuation-in-part application of application Ser. No. 07/782,953, filed on Oct. 25, 1991, in the name of Peter J. Molloy and entitled Smoking Articles, now abandoned.

BACKGROUND OF THE INVENTION

This invention relates to a smoking article in which the smoking material can be tobacco or any other suitable material.

The composition of the smoking material aerosol is complex, containing many compounds in the particulate and vapour phases. It is possible to classify the compounds contained within the particulate phase into two fractions, these are the involatile and semivolatile fractions.

The semivolatile fraction can be defined as consisting of all of those compounds which evaporate from a chemically inert substrate heated to a temperature of 200° C.

Many of the compounds which have been identified as contributors to the taste and flavour of cigarette smoke are contained within the semivolatile fraction. Also it is found experimentally that approximately 50% of the total particulate matter of cigarette smoke is semivolatile.

SUMMARY OF THE INVENTION

It is an object of the present invention to deliver to the smoker an enhanced concentration of semivolatile compounds in the smoke and a reduced concentration of involatiles, thus maintaining taste and flavour at lower total particulate matter yields.

According to the present invention a smoking article comprises a tubular support means to carry a supply of smoking material therein and to provide first and second ends thereof, said first end being located for ignition and said second end being directed towards filter means attached to said tubular support, said filter means including a transversely extending barrier located in a collection zone and on which particulate matter in the smoke from the smoking material is deposited when said second end is ignited and smoke is drawn through the smoking material to the filter means, and heating means for raising the temperature of said collection zone above that which would exist in the absence of said temperature raising means to raise the temperature of said smoke from said smoking material entering said zone and particulate material deposited on said transversely extending barrier, to release semi-volatile compounds therefrom.

In one embodiment said supply of smoking material is provided as a rod and said tubular support is provided as an outer tubular wrapper, said filter means being attached to said rod of smoking material by the wrapper.

Preferably the rod of smoking material includes a longitudinally extending passage to feed hot gases from a first end of said rod when ignited to the said collection zone.

The transversely extending barrier can be provided by an impervious member which has a transversely extending surface on which the particulate matter is deposited by the smoke from the smoking material.

The impervious member can be provided by an impaction disc the centre portion of which provides said transversely extending surface and which is surrounded by an exit opening or openings.

Preferably the disc is provided in a heating chamber into which smoke from the smoking material is delivered and into which the longitudinally extending passage feeds hot gases.

If desired means may be included for accelerating the hot gases from the passage into the collection zone.

In another embodiment the transversely extending barrier can be provided by of a high retention filter element which has a multiplicity of convoluted passages therethrough.

With this arrangement the high retention filter element can be spaced away from the end of the smoking material rod to form a heating chamber and into which smoke from the smoking material is delivered and into which the longitudinally extending passage feeds hot gases.

BRIEF DESCRIPTION OF THE DRAWINGS

A secondary filter element can be provided which is located at the mouth piece end of the article.

Preferably the passage in the rod of smoking material is formed by a low porosity/permeability tube.

According to another construction according to the invention said heating means for raising the temperature in said collection zone is provided by an exothermic chemical reaction element.

In yet another construction according to the invention the heating means for raising the temperature of the collection zone employs an electric current.

Figure 1:
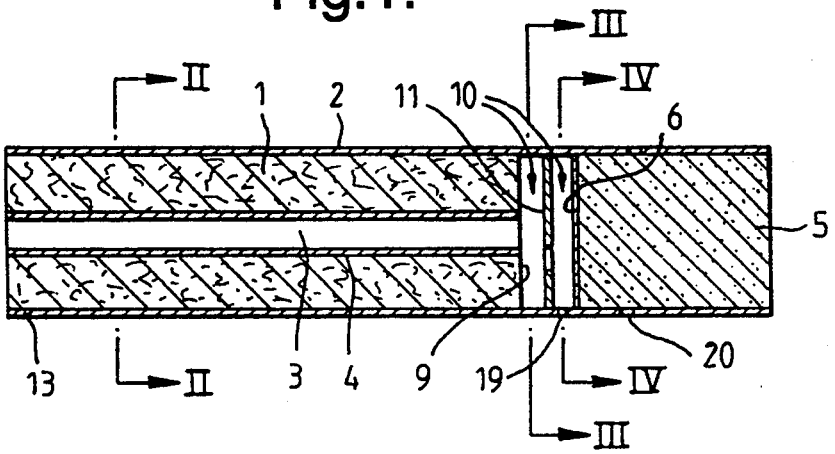
Figure 2:
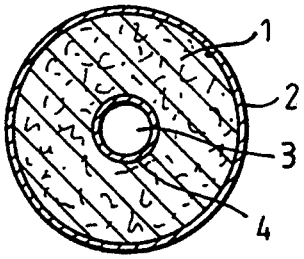
Figure 3:
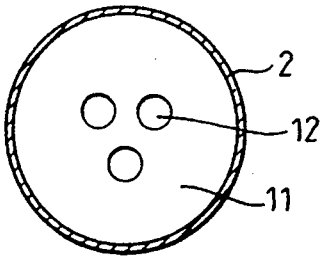
Figure 4:
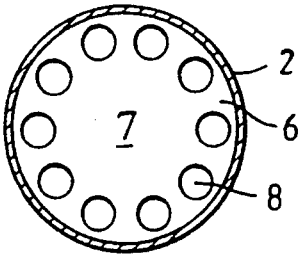
Figure 5:
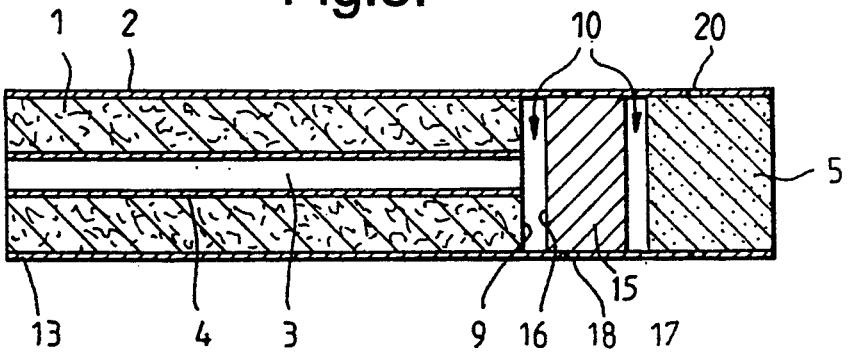
Figure 6:
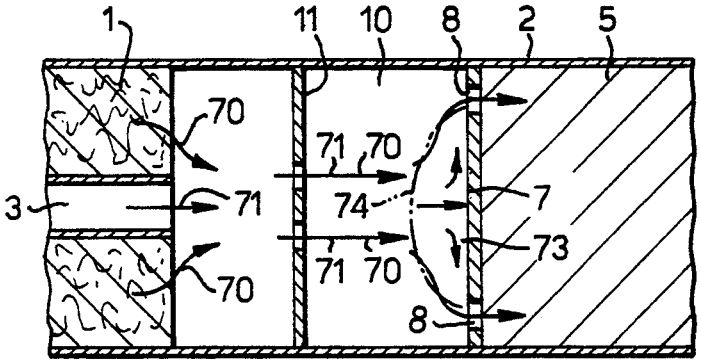
Figure 7:
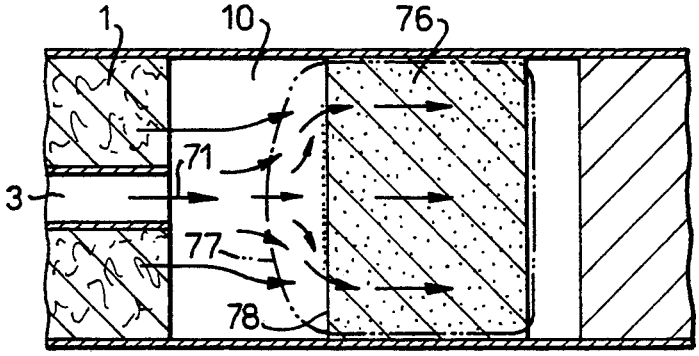
Figure 8:
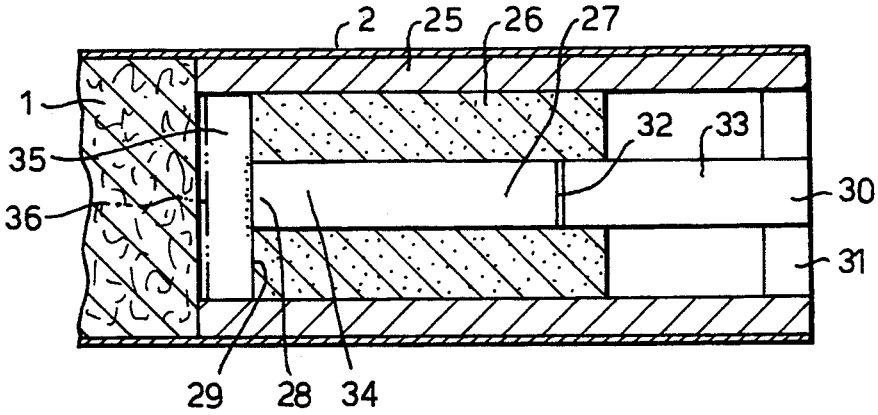
Figure 9:
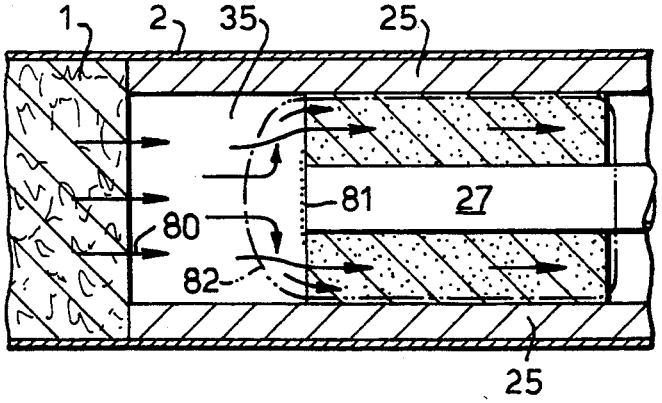
Figure 10:
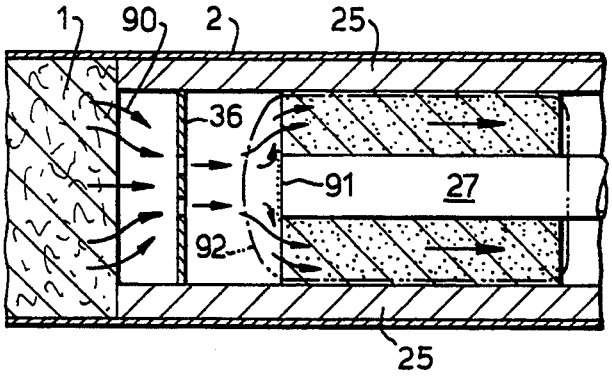
Figure 11:
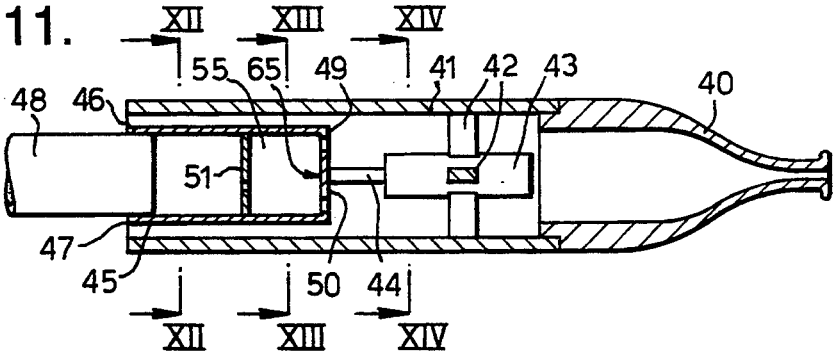
Figure 12:
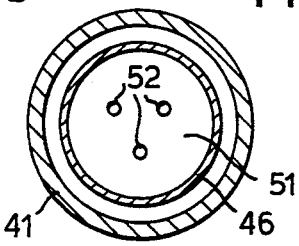
Figure 13:
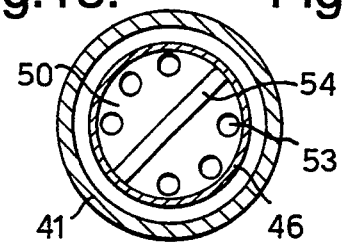
Figure 14:
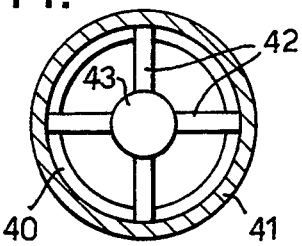
Figure 15:
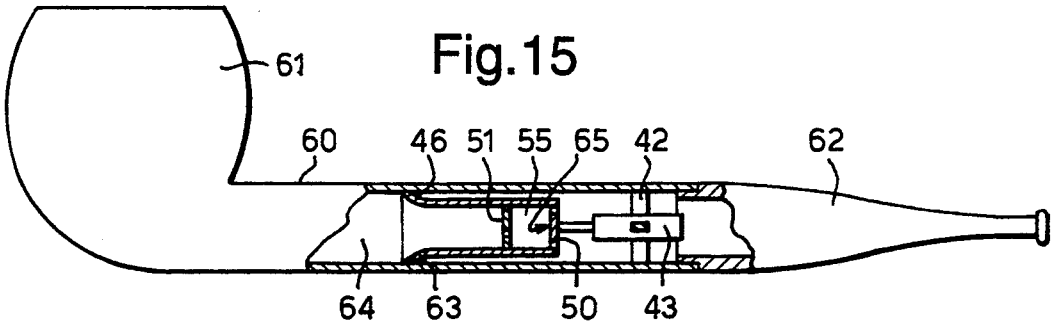

The invention can be performed in various ways and some embodiments will now be described by way of example and with reference to the accompanying drawings in which:

FIG. 1 is a cross-sectional side elevation of a smoking article according to the present invention;

FIG. 2 is a cross-sectional view on the line II—II in FIG. 1;

FIG. 3 is a cross-sectional view on the line III—III of FIG. 1;

FIG. 4 is a cross-sectional view on the line IV—IV of FIG. 1;

FIG. 5 is a cross-sectional side elevation of another construction according to the invention;

FIG. 6 is an enlarged diagrammatic view of the construction shown in FIGS. 1 to 4 showing the gas flow;

FIG. 7 is an enlarged diagrammatic view of the construction shown in FIG. 5 showing the gas flow;

FIG. 8 is a cross-sectional side elevation of another construction according to the invention utilising heating means provided by an exothermic chemical reaction element;

FIG. 9 is an enlarged diagrammatic view of the construction shown in FIG. 5 showing the gas flow;

FIG. 10 is an enlarged diagrammatic view of the construction shown in FIG. 5 showing the gas flow when means for accelerating the gases from the tobacco rod is employed;

FIG. 11 is a cross-sectional side elevation of another embodiment according to the invention in which the heating means are provided by an electric current and in which the filter is embodied in a holder;

FIG. 12 is a cross-sectional view on the line XII—XII of FIG. 11;

FIG. 13 is a cross-sectional view on the line XIII—XIII of FIG. 11;

FIG. 14 is a cross-sectional view on the line XIV—XIV of FIG. 11; and,

FIG. 15 is a part cross-sectional side elevation of a pipe embodying the invention.

DESCRIPTION OF THE PREFERRED EMBODIMENTS

As shown in FIGS. 1 to 4 the smoking article according to the invention comprises a supply of smoking material in the form of a rod 1 of, for example, tobacco carried in a tubular support provided by a paper outer wrapper 2. The rod 1 is provided with a longitudinally extending passage 3 formed by a tube of low porosity/permeability material 4 which may be made from paper or reconstituted tobacco sheet. The tube may have a diameter typically in the range of 0.5 to 5 mm. Attached to the rod 1 is a filter which is located within the paper wrapper 2. The filter comprises a filter element 5 at the mouth piece end and a transversely extending barrier is provided by the transversely extending surface of an impervious impaction disc 6 made of material which is temperature stable. Examples of the materials from which the disc may be constructed include metals, for example aluminium, ceramics or plastics such as nylon, polyethylene, polypropylene or cellulose acetate. Preferably the disc 6 has a low thermal heat capacity and it may also have a low thermal conductivity, for example when constructed from a ceramic or from Nylon 66. This disc 6 has a central impaction surface 7 which is surrounded by circumferential holes 8 typically of 1 mm diameter.

A first end 13 of the supply of smoking material provided by the rod 1 is located for ignition and a second end 9 is directed towards the filter.

Between the second end 9 of the tobacco rod 1 and the surface of the disc 6 a heating chamber 10 is formed in which is located a second disc 11 which can also be made from a material selected from the examples given for the disc 6, and this may be the same as, or different from, that used in the construction of the disc 6 in a particular construction. One or more (three are shown) small diameter holes 12 are provided in the disc 11 and these may typically be of 0.1–1 mm diameter and preferably 0.4–1 mm diameter. These holes act as acceleration nozzles in the manner to be described.

As shown in FIG. 6, when the article is smoked and the end 13 is ignited smoke from the tobacco rod indicated by arrows 70 passes into the heating chamber 10 and through the nozzles 12. The action of passing through the nozzles 12 increases the velocity of the tobacco smoke and assists in the impaction of the smoke against the impaction surface 7 on the disc 6. This causes particulate matter to be deposited in the area 7 and which acts as a collection area for the deposited matter.

Simultaneously hot gases indicated by arrows 71 from the burning tip pass directly down the passage 3, are accelerated through the holes 12 and also impact on the surface 7 thus heating the collection area and deposited particulate matter sufficiently to cause the release of the semivolatile compounds which pass radially outwardly as indicated by arrows 73 with the smoke and through the openings 8 into the filter 5 and to the smoker.

The effect of the hot gases spreads throughout the heating chamber 10 so that the temperature in the chamber is raised. The hot gases particularly raise the temperature of a collection zone indicated by chain line 74 in FIG. 6. This collection zone extends into a portion of the heating chamber for some distance away from the collection area 7, and thus the transversely barrier, provided by the disc 6, is in this collection zone.

Some of the semivolatile compounds may be released as they enter the collection zone before impaction due to the heat in the collection zone and the heating chamber.

The impaction surface 7 is located typically 2mm from the nozzles 12. In the embodiment shown the passage 3 is located coaxially with the smoking material rod 1 but it could be displaced to one side if desired.

In cigarettes employing a normal form of tobacco rod and filter element the temperature of the gases from the burning tip decreases rapidly throughout the length of the tobacco rod and are normally almost ambient when they impinge on the front surface of the filter element. There is only a slight rise in temperature as the end of the tobacco rod is reached. This is due to the effect of the hot gases passing through the unburned tobacco to the smoker. In the present invention however the effect of the heating means, in the form of the tube 3 delivering hot gases directly into the heating chamber causes the temperature in the chamber, especially in the collection zone, to be raised by at least 20° C. and it is this raising in temperature which allows semi-volatile compounds to be released from the gases emerging from the end 9 of the tobacco rod and from the particulate matter deposited in the collection area.

In the second embodiment as shown in FIG. 5 the same reference numerals are used to indicate similar parts as in FIGS. 1 to 4. In this construction the means for collecting particulate matter in the smoke from the rod of smoking material 1 is provided by a high retention filter element 15. High retention filter elements have a multiplicity of convoluted passages through them and can be made in the form of a tow of longitudinally extending fibres which have been crimped or form a sheet of fibres which have been embossed. The multiplicity of convoluted passages provide a multiplicity of angled surfaces in the filter material. Other forms of high retention filter which provide the multiplicity of convoluted passages can also be employed.

The element 15 is spaced away from the end 9 of the smoking material rod 1 and is located in a heating chamber 10 in place of the disc 6. The disc 11 is also dispensed with. In this arrangement smoke from the rod 1 impinges on the front surface 16 of the filter element and the multiplicity of surfaces provided. Together these act as a transversely extending surface. The filter retains a fraction of the total particulate matter and this retained material is again heated by hot gases drawn down the passage 3 as in the previous embodiment. A second filter element 5 can be spaced away from the filter element 15 as shown or it may abut it. Once again the action of the hot gas heats the deposited particulate matter and releases the semivolatile fractions which are then drawn through the filter 5.

The action of the filter element 15 is shown in FIG. 7. The hot gases are again indicated by reference numeral 71 and again serve to heat the heating chamber 10. Particulate matter, indicated by reference numeral 76, is deposited from the gases from the smoking material through the filter element 15 in the convoluted passages of the filter.

The collection zone in this construction extends forwardly of the front surface 78 of the filter into the heating chamber 10 and the whole of the filter element 15 is within it.

The increase in temperature in the heating chamber 10 especially in the collection zone is again at least 20° C. above the temperature which the zone would reach in the absence of the heating means.

The second filter element 5 may have an inclusion of activated carbon to reduce the concentration of some of the vapour components in the smoke aerosol.

If desired ventilation air may be introduced through the wrapper 5 into the filter 17 through openings 18 to confine the aerosol and the hot air/smoke stream to the central part of the filter.

Similarly in the construction shown in FIG. 1 ventilation air may be introduced through the wrapper 5 through openings 19 to aerodynamically focus the aerosol onto the disc 6 to improve the efficiency of the filter.

If desired ventilation air may also be used to cool the evaporated semivolatiles to facilitate recondensation before delivery to the smoker, for example through openings 20.

FIG. 8 shows the use of an exothermic chemical reaction element to raise the temperature in a heating chamber by heating a collection zone to raise the temperature of the zone including the transversely extending barrier and any previously impacted matter and smoke entering the zone from the tobacco rod, with a consequent transfer of semivolatile compounds from the particulate phase to the vapour phase.

Once again the temperature of the zone is increased by at least 20° C. above the temperature which the zone would have reached in the absence of the means for heating.

In the construction shown in FIG. 8 the tobacco rod is again indicated by reference numeral 1 and is carried in a paper outer wrapper 2. In this construction an insulation tube 25 made from, for example, a plastics material such as polypropylene or a ceramics material is provided at the mouthpiece end and within which is located a plug 26 of high retention filter material. Mounted coaxially within the plug 26 is an exothermic reaction element comprising a hollow tube 27 made from a suitable plastics material such as polypropylene. The inner end 28 of the tube 27 is aligned with the inner end 29 of the plug 26. The outer end 30 of the tube 27 is aligned with the mouthpiece end of the total filter unit and is held in place by a cellulose acetate disc 31.

The tube 27 contains a frangible separator 32 which divides the tube into a chamber 33 containing water and a chamber 34 containing calcium oxide.

The inner end 28 of the tube 27 and the multiplicity of angled surfaces in the convoluted passages in the plug 26, provide transversely extending surfaces. The inner ends 28 of the tube and inner end 29 of the plug are separated from the tobacco rod 1 to provide a heating chamber 35. The exothermic chemical reaction between water and calcium oxide serves to heat and raise the temperature of the smoke entering the chamber 35, the impaction surfaces at the end 28 of the tube 27 and within the plug of high efficiency filter material 26, and any particulate matter previously impacted on these impaction surfaces.

In order to provide the heat for raising the temperature of the chamber 35 the filter containing the tube 27 is crushed slightly between the user's fingers which causes the frangible wall 32 to fracture and allow the water in the chamber 33 to mingle with the calcium oxide in the chamber 34 and produce heat.

The gas flow through the construction shown in FIG. 8 is illustrated in FIG. 9. The gases from the burning tobacco rod 2 are indicated by arrows 80 entering the heating chamber 35 and are deflected at the centre by an impaction surface 81 formed by the inner end 28 of the tube 27. A collection area is formed on the inner end 28 of the tube 27 and on the multiplicity of angled surfaces in the convoluted passages in the plug 26. The collection zone is indicated by broken line 82. As will be seen the collection zone includes the plug in a similar manner to the construction shown in FIGS. 5 and 7.

The heat produced is sufficient to raise the temperature of the collection zone and hence the temperature in the chamber 35 by at least 20° C. above the temperature which the chamber would have reached in the absence of the means for heating when the cigarette is smoked, and the action of the heating is once again to cause transfer of semivolatile compounds from the particulate phase to the vapour phase.

If desired an accelerator plate similar to the disc 11 as shown in FIG. 1 can be provided at the end of the tobacco rod 1 as shown in broken lines 36, and FIG. 10 shows the gas flow through such a construction, the gases form the tobacco rod being indicated by arrows 90. In this arrangement a greater proportion of the particulate matter will be collected on the inner end 28 of the tube 27 and the inner end 29 of the plug 26 than is the case with the embodiment shown in FIGS. 8 and 9. The collection area and collection zone 92 are however similar.

It will be appreciated that the heat is provided by exothermic chemical reaction between the calcium oxide and the water but other materials could be used, for example, the combustion of a separate carbonaceous fuel element and the oxidation of organic compounds such as methanol by air when exposed to a suitable catalyst. The arrangement for allowing the various materials to intermingle can be arranged in a similar manner to that described and shown in FIG. 8, the materials being carried in the compartments 33 and 34 appropriately.

FIG. 11 shows a construction in which the temperature at a collection zone located within a heating chamber is raised by the use of an electric current. In this construction the collection zone located in a heating chamber is mounted within a cigarette holder having a removable mouthpiece 40. The mouthpiece 40 is screwed or pushed into an insulation tube 41 made from any suitable material, for example a plastics material. Located in the tube 41 is a cruciform batter holder 42 which carries a replaceable or rechargeable battery 43. The battery is connected by suitable electric connections 44 to a carrier 45 which is formed by a metallic tube 46 a first end 47 of which is proportioned to receive and carry a cigarette or cigar 48 so that it communicates with the supply of smoking material. The second end 49 of the tube 46 is closed by an end wall 50 so that it acts as a transversely extending surface and the metallic tube carries a metallic accelerator plate 51 at an intermediate position.

The metallic tube 46 carries an accelerator plate 51 as shown in FIG. 12 and this is provided with small diameter holes 52 so that the plate acts in a similar manner to the disc 11 shown in FIG. 1. End wall 50 is also provided with holes 53 in a similar manner to the disc 6 as shown in FIG. 1. The electrical connection can be directly connected to the plate to cause it to heat up or can be connected to an electrical heating element 54 mounted on the plate.

A suitable switch is provided (not shown) which could, for example, be operated by rotating or depressing the mouthpiece 40 to allow the battery to energise and heat the carrier 47 which is made throughout of a suitable heat conducting metal, alternatively carrier 47 could be made of a suitable heat resisting material, the heat being provided by the electrical heating element 54.

In this construction the supply of smoking material is therefore carried in the cigarette wrapper and the filter is carried in a holder provided with a mouthpiece and which is removably attachable to the cigarette wrapper.

In use a cigarette is inserted into the carrier 47 and when the battery is operated the carrier heats up. Smoke from the cigarette passes through the acceleration holes 52 in the accelerator plate 51 and enters a heating chamber 55 located between the accelerator plate 51 and the end wall 50. The accelerated smoke entering the chamber 55 behaves in a somewhat similar manner to that described with regard to FIG. 1, that is the centre of the surface of the plate 50 acts as an impaction surface and collection area and a collection zone are formed. The temperature of the collection zone and hence the chamber is again heated so that its temperature is at least 20° C. higher than it would have been if the heating chamber had been reached by the smoke in the absence of means for heating. The heating has the effect described with regard to the other embodiments, the treated smoke passes through the openings 53 in the end plate 50 and to the mouthpiece.

FIG. 15 shows the use of similar apparatus to that shown in FIG. 7 but in which the supply of smoking material is carried in a tubular pipe bowl which acts as a tubular support and which is attached to a hollow stem provided with a mouthpiece and within which a filter is provided. Thus in FIG. 15 the invention is embodied in a pipe 60 which has a bowl 61 to receive tobacco in the usual way. The mouthpiece 62 of the pipe is removable and the construction of the filtering apparatus is substantially the same as that shown in FIG. 7 with the exception that the first end 63 of the metallic tube 46 is flared outwardly so that it embraces the whole of the cross-sectional area of the smoke passage 64 leading to the pipe bowl 61. This ensures that all smoke coming from the pipe bowl enters the metallic tube 46.

In the construction shown in FIGS. 11, 12, 13, 14 and 15 the metallic filtration element provided by the tube 46 can be disposable if required and the battery 43 can be disposable or rechargeable.

When this electrically operated construction is used the heating chamber 55 is heated to raise the temperature therein which thus causes a rise in temperature of the impaction surface indicated by reference numeral 65 and any previously impacted smoke as well as smoke entering the collection zone provided within the chamber 55. Consequently there is transfer of semivolatile compounds from the particulate phase to the vapour phase.

In the arrangement described above there is reference to the system included a switching mechanism so that the current can be activated by manual operation but if desired some other trigger arrangement could be included such as a pressure change when a puff is taken. Although a preferred embodiment of the invention has been specifically illustrated and described herein, it is to be understood that minor variations may be made in the apparatus without departing from the spirit and scope of the invention, as defined the appended claims.

I claim:

1. A smoking article comprising a smoking material rod and filter means, said rod having support means forming a tube with smoking material therein, said filter means being attached to said support means, said rod having first and second ends, said first end being a free end and said second end being adjacent said filter means, said filter means including a barrier extending transversely of the tube and located in a collection zone on which barrier particulate matter in the smoke from the smoking material is deposited when said first end is ignited and smoke is drawn through the smoking material rod to the filter means, and said rod including a heating means comprising a hollow passage extending longitudinally of said rod from the first end to the second end to feed hot gases from said first end of said rod when ignited to said collection zone for raising the temperature therein above that which would exist in the absence of said passage to cause release of semi-volatile compounds from said deposited particulate matter.

2. A smoking article as claimed in claim 1 in which said barrier is an impervious member which has a surface extending transversely of the tube and on which the particulate matter is deposited by the smoke from the smoking material.

3. A smoking article as claimed in claim 2 in which said impervious member is provided by an impaction disc the centre portion of which provides said transversely extending surface and which includes at least one exit opening.

4. The smoking article as defined in claim 3 wherein said disc centre portion is surrounded by a plurality of openings.

5. A smoking article as claimed in claim 3 in which said disc is located in a chamber into which smoke from the smoking material is delivered and into which the longitudinally extending passage feeds hot gases.

6. A smoking article as claimed in claims 1 including means for accelerating the hot gases from the longitudinally extending passage into said collection zone.

7. A smoking article as claimed in claim 6 including means for accelerating the smoke from the smoking material and the hot gases from the passage into said collection zone.

8. A smoking article as claimed in claim 7 in which the means for accelerating the hot gases or hot gases and smoke includes a disc of impervious material having one or more holes within the range of 0.1 to 1.0 mm diameter.

9. A smoking article as claimed in claim 1 in which said transversely extending barrier is provided by a high retention filter element which has a multiplicity of convoluted passages therethrough.

10. A smoking article as claimed in claim 9 in which said high retention filter element is spaced away from said second end of said rod to form a chamber into which smoke from the smoking material is delivered and into which the longitudinally extending passage feeds hot gases.

11. A smoking article as claimed in claim 1 in which said longitudinally extending passage in the rod of smoking material is defined by a low porosity/permeability tube.

12. A smoking article comprising a tubular support means, a charge of smoking material in said tubular support means, said smoking material having first and second ends, said first end being for ignition and said second end being closer to filter means attached to said tubular support than said first end, said filter means including a barrier extending transversely of the support means and located in a collection zone and on which particulate matter in the smoke is drawn through the smoking material to the filter means, and heating means for raising the temperature of said collection zone above that which would exist in the absence of said heating means to raise the temperature of said smoke from said smoking material entering said zone and of said deposited particulate matter on said barrier, to release semi-volatile compounds therefrom, and said heating means for raising the temperature in said collection zone being a chemical system for undergoing an exothermic chemical reaction.

13. A smoking article as claimed in claim 12 in which said exothermic chemical reaction element is located in a high retention filter element having a multiplicity of convoluted passages therein.

14. A smoking article as claimed in claim 15 in which a portion of said exothermic chemical reaction element forms part of a transversely extending surface.

15. A smoking article as claimed in claim 13 in which said higher retention filter is spaced away from a second end of said rod to form a chamber into which smoke from the smoking material is delivered.

16. A smoking article as claimed in claim 15 including means for accelerating the smoke from the smoking material into said collection zone.

17. A smoking article as claimed in claim 16 in which the means for accelerating the smoke includes a disc of impervious material having one or more holes within the range 0.1 mm to 1.0 mm diameter.

18. A smoking article as claimed in claim 12 in which said exothermic chemical reaction element contains chemical reaction agents in separate compartments which can be interconnected by operation of the user.

19. A smoking article as claimed in claim 18 in which the chemical reaction agents are taken from the group containing calcium oxide and water, a separate carbonaceous fuel element, the oxidation of organic compounds by air when exposed to a suitable catalyst.

20. A smoking article as claimed in claim 18 in which said element is operated by crushing by the user.

21. A smoking article comprising a tubular support means, a charge of smoking material therein, said smoking material charge having first and second ends, said first en being for ignition and said second end being closer to filter means attached to said tubular support than said first end, said filter means including a barrier extending transversely of the support means and located in a collection zone and on which particulate matter in the smoke from the smoking material is deposited when said first end is ignited and smoke is drawn through the smoking material to the filter means, and heating means for raising the temperature of said collection zone above that which would exist in the absence of said heating means to raise the temperature of said smoke from said smoking material entering said zone and of said deposited particulate matter on said barrier, to release semi-volatile compounds therefrom, and said heating means for raising the temperature of said deposited particulate matter employs an electric current.

22. A smoking article as claimed in claim 21 in which said barrier is provided as an impervious transversely extending surface which is the second end of a heating chamber the first end of which communicates with said second end of said charge of smoking material, said second end of said chamber being heated by said electric current.

23. A smoking article as claimed in claim 22 in which said charge of smoking material is carried in a wrapper to form a cigarette and said filter is carried in a holder provided with a mouthpiece and which is removably attachable to said cigarette.

24. A smoking article as claimed in claim 23 in which said electric current is provided by an electrical battery carried in said holder.

25. A smoking article as claimed in claim 24 including means for accelerating the smoke from said smoking material into said collection zone.

26. A smoking article as claimed in claim 25 in which the means for accelerating the hot gases includes a disc of impervious material having one or more holes within the range of 0.1 mm to 1.0 mm diameter.

27. A smoking article ass claimed in claim 22 in which said second end of said heating chamber is made from an electrically conducting material.

28. A smoking article as claimed in claim 22 in which said charge of smoking material is carried in a tubular pipe bowl which acts as a tubular support, and which is attached to a hollow stem provided with a mouthpiece and within which said filter is located.

29. A smoking article as claimed in claim 28 in which said electric current is provided by an electrical battery carried in said stem.

30. A smoking article as claimed in claim 29 including means for accelerating the smoke from said smoking material into said collection zone.

31. A smoking article as claimed in claim 30 in which the means for accelerating the hot gases includes a disc of impinge material having one or more holes within the range of 0.1 mm to 1.0 mm diameter.

32. A smoking article as claimed in claim 28 in which said second end of said heating chamber is made from an electrically conducting material.

* * * * *